US007043171B2

(12) United States Patent
Ogata

(10) Patent No.: US 7,043,171 B2
(45) Date of Patent: May 9, 2006

(54) IMAGE FORMING APPARATUS

(75) Inventor: Takao Ogata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/125,083

(22) Filed: May 10, 2005

(65) Prior Publication Data

US 2005/0207765 A1 Sep. 22, 2005

Related U.S. Application Data

(62) Division of application No. 10/673,508, filed on Sep. 30, 2003, now Pat. No. 6,959,156.

(30) Foreign Application Priority Data

Oct. 2, 2002 (JP) ..... 2002-290521

(51) Int. Cl.
*G03G 15/10* (2006.01)
*G03G 15/08* (2006.01)

(52) U.S. Cl. ..... 399/61; 399/27; 399/258

(58) Field of Classification Search ..... 399/60, 399/27, 29, 30, 61, 62, 258
See application file for complete search history.

(56) References Cited

U.S. PATENT DOCUMENTS

| | | | | |
|---|---|---|---|---|
| 3,679,099 | A | 7/1972 | Bullock et al. | 222/55 |
| 4,669,856 | A | 6/1987 | Yamada | |
| 5,253,018 | A | 10/1993 | Takeuchi et al. | |
| 5,450,177 | A | 9/1995 | Oyama | |
| 5,469,244 | A | 11/1995 | Ogata et al. | |
| 5,559,587 | A | 9/1996 | Ogata et al. | |
| 6,029,021 | A | 2/2000 | Nishimura et al. | 399/49 |
| 6,075,954 | A | 6/2000 | Ogata et al. | 399/60 |
| 6,442,355 | B1 | 8/2002 | Hasegawa et al. | 399/58 |
| 2002/0025178 | A1 | 2/2002 | Suzuki | 399/30 |
| 2002/0051142 | A1 | 5/2002 | Ogata et al. | 358/1.8 |
| 2003/0147661 | A1 | 8/2003 | Ogata | 399/58 |

*Primary Examiner*—Sandra L. Brase
(74) *Attorney, Agent, or Firm*—Fitzpatrick, Cella, Harper & Scinto

(57) ABSTRACT

An image forming apparatus includes a developing device for developing an electrostatic image formed on an image bearing member with developer including toner and carrier, a density sensor for detecting a density of the toner, a control unit for controlling the amount of toner to be supplied to the developing device by comparing an output of the density sensor with a target value, a changing unit for changing the target value when the output of the density sensor falls into an error level, and a recovering unit for supplying the toner based on the target value changed by the changing unit to perform a recovery operation.

3 Claims, 6 Drawing Sheets

IMAGE FORMING APPARATUS

CROSS-REFERENCE TO RELATED APPLICATION

This application is a divisional of application Ser. No. 10/673,508, filed Sep. 30, 2003, now U.S. Pat. No. 6,959,156.

BACKGROUND OF THE INVENTION

1. Field of the Invention

The present invention relates to image forming apparatuses using electrophotographic systems and electrostatic systems, and particularly to image forming apparatuses such as copying machines, printers, and facsimile apparatuses.

2. Related Background Art

In image forming apparatuses, such as copying machines, printers, and facsimile apparatuses, using as developer two-component developer with main components of toner and carrier, toner is spent and a developer density in a developing apparatus gradually decreases as image formation proceeds.

Accordingly, the developing apparatus is equipped with a toner supplying apparatus for supplying toner, and toner in the toner supplying apparatus is occasionally supplied to the developing apparatus based on an output of a sensor for sensing the density of developer in the developing apparatus, such that the density of developer in the developing apparatus can be kept constant.

Further, a toner image (a test patch) for detection of an image density is formed on a photosensitive drum, and the image density is read by an image density detecting sensor. The thus-read value of the image density is compared with a reference value, and the toner supplying apparatus is accordingly driven. Toner is thus supplied such that the output of the image density detecting sensor can be always maintained at a constant value, thereby controlling the image density to obtain an appropriate image.

However, even when the image density is controlled by a bias using the developer density detecting sensor and the image density sensor as discussed above, fogging is likely to occur due to excessive supply of toner if the developer density is forcedly recovered at the time of recovery operation subsequent to detection of an anomalous condition of the developer density. Even in the event that no fogging appears, variation in the image density is liable to occur.

SUMMARY OF THE INVENTION

It is an object of the present invention to provide an image forming apparatus capable of appropriately performing a recovery operation after the output of a density sensor falls into an error level.

It is another object of the present invention to provide an image forming apparatus capable of appropriately controlling an image density subsequent to a recovery operation.

It is still another object of the present invention to provide an image forming apparatus capable of preventing occurrence of fogging and reducing variation in an image density subsequent to a recovery operation.

These and further aspects and features of the invention will become apparent from the following detailed description of preferred embodiments thereof in conjunction with the accompanying drawings.

DETAILED DESCRIPTION OF THE PREFERRED EMBODIMENTS

Figure 1:
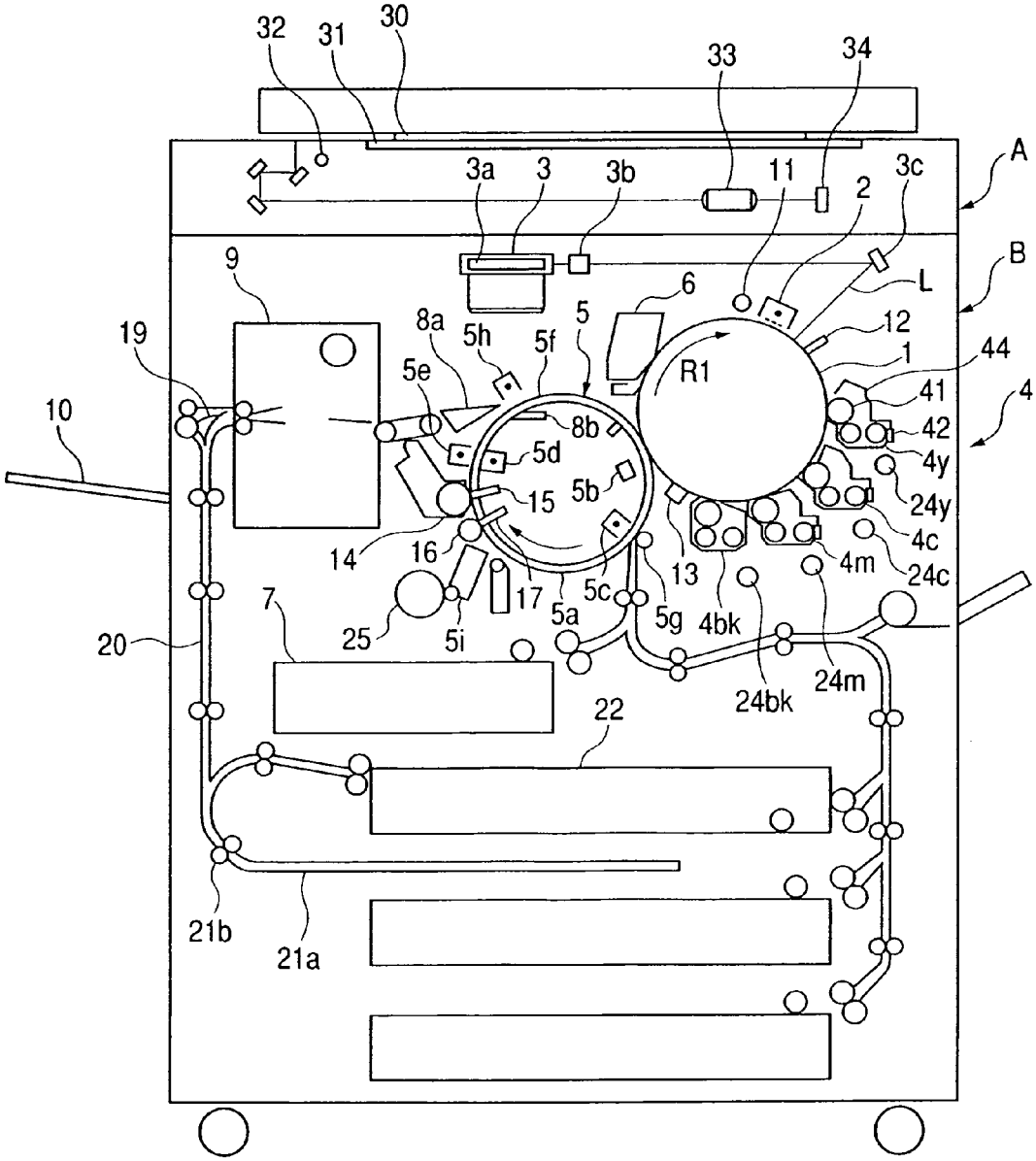
FIG. 1 is a longitudinal cross-sectional view schematically illustrating the structure of an image forming apparatus of a first embodiment according to the present invention.

Embodiments of the present invention will hereinafter be described with reference to the drawings. Like reference numerals in the drawings designate portions or elements having the same construction or function, respectively. Repetitive description of each common portion or element is appropriately omitted.

(First Embodiment)

FIG. 1 illustrates an image forming apparatus of a first embodiment according to the present invention. The image forming apparatus illustrated in FIG. 1 is directed to a four-color, full color image forming apparatus of an electrophotographic system and a digital system. FIG. 1 is a longitudinal cross-sectional view schematically illustrating the structure of the image forming apparatus.

The image forming apparatus illustrated in FIG. 1 has an upper portion of a digital color image reader portion (simply referred to as a reader portion in the following description) R, and a lower portion of a digital color image printer portion (simply referred to as a printer portion in the following description) P.

In the reader portion R, an original 30 is placed on an original support glass 31, a reflected-light image generated by exposure-scanning the original 30 with an exposure lamp 32 is condensed onto a full color sensor 34 by a lens 33, and color separation image signals are thus obtained. The color separation image signals are supplied to a video processing unit (not shown) through an amplifying circuit (not shown), and processed by the video processing unit. The thus-processed image signals are supplied to the printer portion P.

In the printer portion P, a drum-type electrophotographic photosensitive member (hereinafter referred to as a photosensitive drum) 1 serving as an image bearing member is supported rotatably in a direction indicated by the arrow R1. In the neighborhood of the photosensitive drum 1, there are arranged a pre-exposure lamp 11, a corona charging device 2, an exposure optical system 3, a potential sensor 12, a developing apparatus 4 (developing devices 4*y*, 4*c*, 4*m* and 4*bk*), an image density detecting sensor (a patch detecting sensor) 13, a transferring apparatus 5, a cleaning apparatus 6, and the like.

A laser scanner is used as the exposure optical system 3. In the laser scanner, the image signal supplied from the reader portion R is converted into an optical signal by a laser output portion (not shown), laser light L is then reflected by a polygon mirror 3*a*, and the light is linearly scanned (raster scanned) on a surface of the photosensitive drum 1 through a lens 3*b* and a mirror 3*c*. An electrostatic latent image is thus formed on the surface of the photosensitive drum 1.

In the printer portion P, at the time of the image forming operation, the photosensitive drum 1 is rotated in the direction indicated by the arrow R1 at a predetermined process speed (a circumferential speed), and the surface of the photosensitive drum 1 is uniformly charged at a predetermined potential of a predetermined polarity by the corona charging device 2 after charges on the surface of the photosensitive drum 1 are removed by the pre-exposure lamp 11. After that, the surface of the photosensitive drum 1 is irradiated with laser light L for each separated color by the exposure optical system 3 to form an electrostatic latent image on the surface of the photosensitive drum 1.

A predetermined developing device for each separated color is then operated to develop each electrostatic latent image formed on the photosensitive drum 1. A toner image for each separated color is thus formed on the surface of the photosensitive drum 1 with toner including resin as its principal substance. The developing devices 4*y*, 4*c*, 4*m* and 4*bk* are constructed so as to selectively approach the photosensitive drum 1 in conformity with each separated color under actions of developing pressure cams (eccentric cams) 24*y*, 24*c*, 24*m* and 24*bk*, respectively.

Each toner image formed on the photosensitive drum 1 is then transferred onto a recording material, which is supplied, to a location facing the photosensitive drum 1 from a sheet feeding cassette 7 through a conveyance system and the transferring apparatus 5. In the first embodiment, the transferring apparatus 5 includes a transferring drum 5*a*, a transfer charging device 5*b*, an attracting charging device 5*c* for performing electrostatic attraction of the recording material, an attracting roller 5*g* facing the attracting charging device 5*c*, an inner charging device 5*d*, and an outer charging device 5*e* facing the inner charging device 5*d*. Further, a cylindrical recording material bearing sheet 5*f* formed of an insulating material is extendedly provided in a united form around a peripheral opening region of the transferring drum 5*a*, which is pivotally supported to be rotatably driven. An insulating sheet, such as a polycarbonate film, is used as the recording material bearing sheet 5*f*.

As the transferring drum 5*a* rotates, the toner image on the photosensitive drum 1 is transferred onto the recording material carried on the recording material bearing sheet 5*f* by the transfer charging device 5*b*.

Toner images of yellow, cyan, magenta and black sequentially formed on the photosensitive drum 1 are sequentially transferred to the recording material attracted and conveyed by the recording material bearing sheet 5*f* as discussed above, and these four color toner images are superimposed on the recording material.

In the case of a four color mode, after transfer of those four color toner images is thus completed, the recording material is separated from the transferring drum 5*a* by actions of a separating claw 8*a*, a separating push-up roller 8*b*, and a separating charging device 5*h*. The toner images are then fixed on the surface of the recording material by a thermal roller fixing device 9, and the recording material is then discharged onto a sheet discharging tray 10.

On the other hand, with respect to the photosensitive drum 1 subsequent to the transfer of those toner images, toner (waste toner) remaining on its surface without being transferred on the recording material is removed by the cleaning apparatus 6, and thereafter the photosensitive drum 1 is again provided for an image formation process.

In the event that images are formed on opposite surfaces (a front surface and a rear surface) of the recording material, respectively, a conveyance path switching guide 19 is driven immediately after the recording material is discharged from the thermal roller fixing device 9. Then, the recording material is once guided into a surface reverse path 21*a* through a longitudinal sheet discharging path 20, and is once stopped. Thereafter, the recording material is conveyed in a direction opposite to its supply direction with its rear end at the supply time being a leading head by reverse rotation of a reversal roller 21*b*, and its front surface and rear surface are reversed. The reversed recording material is then stocked in an intermediate tray 22. After that, an image is again formed on the other surface of the recording material during the above-discussed image formation process.

Further, the recording material bearing sheet 5*f* on the transferring drum 5*a* is likely to be contaminated due to deposition of powders scattered from the photosensitive drum 1, the developing apparatus 4, the cleaning apparatus 6 and the like, deposition of toner at the time of jam of the recording material (cramming of the recording material), deposition of oil on the recording material at the time of image formation process on its opposite surfaces, and so forth. However, the recording material bearing sheet 5*f* on the transferring drum 5*a* can be cleaned by a fur brush 14 and a back-up brush 15 facing the fur brush 14 through the recording material bearing sheet 5*f*, or an oil removing roller 16 and a back-up brush 17 facing the oil removing roller 16 through the recording material bearing sheet 5*f*, and is thereafter subjected to the image formation process. Such cleaning is executed at the time of pre-rotation or post-rotation, and is occasionally carried out in the event of occurrence of the jam.

Further, in the first embodiment, the structure is constructed such that a gap between the recording material bearing sheet 5*f* and the photosensitive drum 1 can be set to a predetermined distance with a predetermined timing by actions of an eccentric cam 25 for the transferring drum, and a cam follower 5*i* integrally formed with the transferring drum 5*a*. For example, it is possible to increase the distance between the transferring drum 5*a* and the photosensitive drum 1 and make the rotation of the transferring drum 5*a* independent from the rotation of the photosensitive drum 1 during a standby time, or at an OFF time of the electrical power source.

Figure 2:
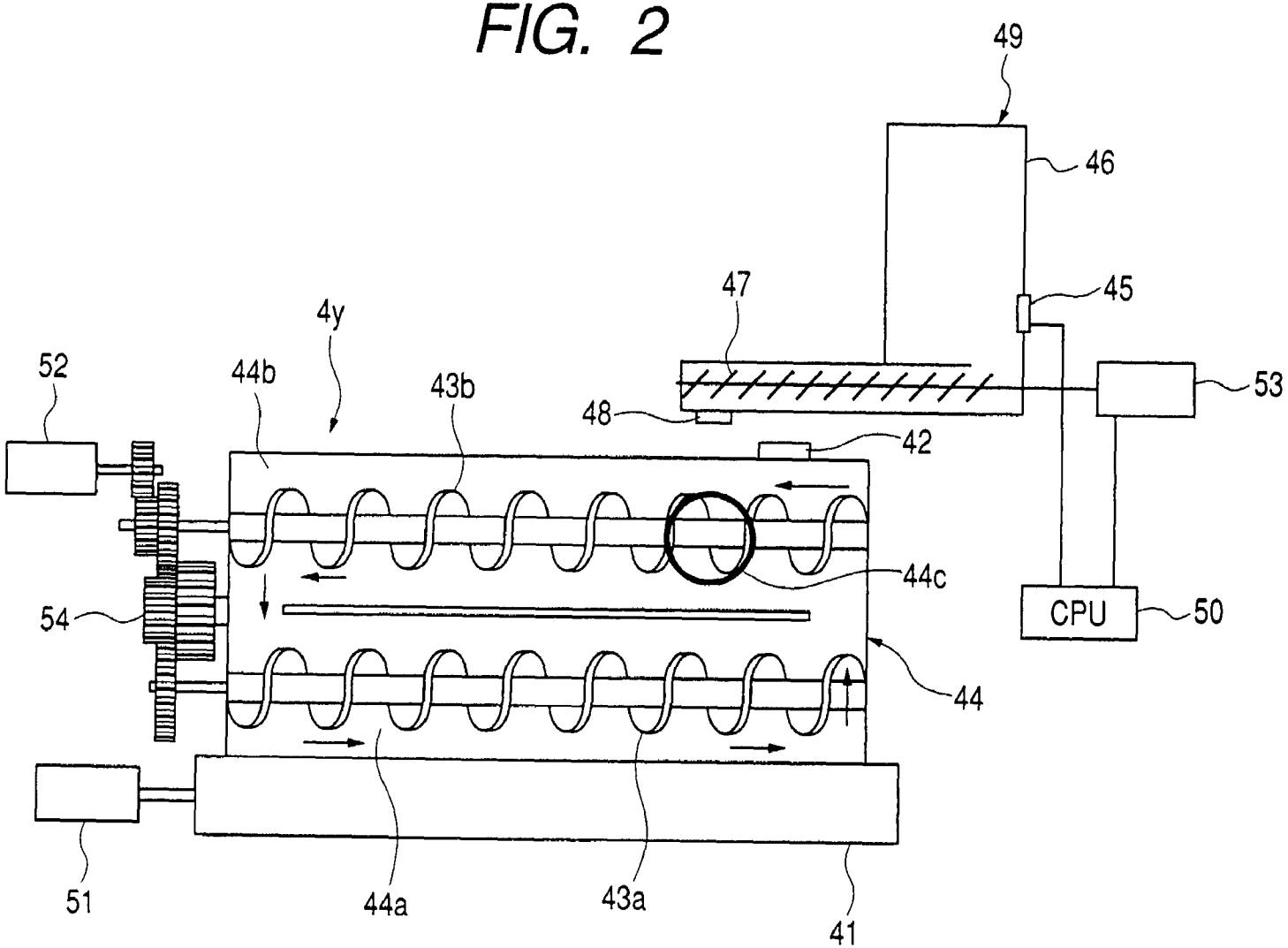
FIG. 2 is a longitudinal cross-sectional view illustrating structures of a developing apparatus and a toner supplying apparatus.

FIG. 2 is a longitudinal cross-sectional view illustrating the above-discussed yellow-color developing device 4*y*, and the toner supplying apparatus 49 for supplying yellow toner to this yellow-color developing device 4*y*. FIG. 2 is the longitudinal cross-sectional view taken along an axis of a developing sleeve 41.

The developing device 4*y* includes a developer container 44 for containing two-component developer with main components of toner and carrier therein, agitating and carrying screws 43*a* and 43*b* provided in the developer container 44 as two developer carrying members, and the developing sleeve 41 serving as a developer carrying member. Those members 44, 43*a*, 43*b* and 41 are provided parallel to each other. The developer container 44 is partitioned into upper and lower developer containing chambers 44*b* and 44*a*, and these chambers 44*b* and 44*a* are communicated to each other at their left ends and right ends.

The agitating and carrying screw 43*b* is provided in the upper developer containing chamber 44*b*, and the agitating and carrying screw 43*a* is provided in the lower developer containing chamber 44*a*. Those agitating and carrying screws 43*b* and 44*a* are driven and rotated by rotation of a motor 52 in the same direction through a gear train 54. By dint of that rotation, developer in the upper developer containing chamber 44*b* is moved leftward in FIG. 2 while being agitated, and is dropped into the lower developer containing chamber 44*a*, while developer in the lower developer containing chamber 44*a* is moved rightward in FIG. 2 while being agitated, and is pushed up into the upper developer containing chamber 44*b*.

In other words, developer is carried and circulated while being agitated by those two agitating and carrying screws 43*a* and 43*b*. Such agitation and carriage cause toner in the developer to be given electrical charge. On a right end portion of the upper developer containing chamber 44*b*, a window 44*c* for enabling a user to monitor an inner condition of the container 44 from outside is provided, and a sensor 42 for detecting the developer density is mounted.

Where a most upstream location of the above-discussed circulation of developer is defined by a position at which toner is supplied from a toner supplying apparatus 49 described later, the mount position of the developer density detecting sensor 42 is a most downstream location. In other words, the developer density detecting sensor 42 is situated so as to detect the developer under a most-agitated condition.

Here, the toner density means a mixture ratio of toner in the two-component developer with main components of toner and carrier which is contained in the developing apparatus 4.

The developing sleeve 41 is driven and rotated in a counterclockwise direction in FIG. 1 by the motor 51. The rotation of the developing sleeve 41 carries developer put on its surface in a layer form by a regulation blade (not shown) to a developing position facing the surface of the photosensitive drum 1. The developer thus carried to the developing position causes toner to be applied to an electrostatic latent image on the photosensitive drum 1, and hence the electrostatic latent image is developed as a toner image. Toner in two-component developer is spent due to that development, and the density of toner in the developer container 44 gradually decreases.

Toner is occasionally supplied to the developer container 44 by the toner supplying apparatus 49. The toner supplying apparatus 49 includes a toner supplying tank 46 for containing toner therein, a toner supplying port 48 provided at a lower left end portion in FIG. 2 of the toner supplying tank 46, a carrying screw 47 for carrying toner toward the toner supplying port 48, a motor for driving and rotating the carrying screw 47, a CPU (a controlling apparatus) 50 for controlling the rotation of the motor 53, and a toner presence/absence detecting sensor 45 for detecting if or not a predetermined or more amount of toner is contained in the toner supplying tank 46. Under a condition under which the toner presence/absence detecting sensor 45 has detected that the predetermined amount of toner is contained in the toner supplying tank 46, a corresponding relationship between a rotation period of time of the motor 53 and the amount of toner supplied to the developer container 44 through the toner supplying port 48 by rotation of the carrying screw 47 due to this rotation of the motor 53 is beforehand obtained by experiment or the like. Its result is stored in the CPU 50 as a table, for example. Accordingly, the CPU 50 regulates the amount of toner supplied to the developer container 44 by controlling (regulating) the rotation period of time of the motor 53.

In the foregoing, the yellow-color developing device 4*y* and the toner supplying apparatus 49 are discussed. Those yellow-color constructions and operations are the same as those of other developing devices and toner supplying apparatuses, i.e., a cyan-color developing device 4*c*, a magenta-color developing device 4*m* and a black-color developing device 4*bk*, and toner supplying apparatuses 49 corresponding thereto. Descriptions thereof are therefore omitted.

In a sequential image formation operation of the above-discussed image forming apparatus, the developing apparatus 4 and the toner supplying apparatus 49 are operated in the following manner. The operation will be described with reference to FIGS. 1 and 2.

When an electrostatic latent image for yellow color on the photosensitive drum 1 reaches its developing position, a developing bias created by superimposition of an AC voltage and a DC voltage is applied to the developing sleeve 41 of the developing device 4*y* by an electrical power source (not shown) for applying a developing bias. At this moment, the developing sleeve 41 is driven and rotated in a counterclockwise direction in FIG. 1 by the motor 51, and is pressed against the surface of the photosensitive drum 1 by pressure from the developing pressure cam 24. Yellow toner in the developer contained in the developer container 44 is then applied to the electrostatic latent image on the surface of the photosensitive drum 1 by dint of the above-discussed bias, and the electrostatic latent image is developed as a yellow toner image.

The developer density detecting sensor 42 detects the density of developer in the developing device 4*y* under a condition of developer at the time of development of the electrostatic latent image on the photosensitive drum 1. Based on its detection result, the toner supplying apparatus 49 containing toner to be supplied is driven such that the density of developer in the developing device 4*y* can be kept constant. In other words, based on the detection result of the developer density detecting sensor 42, the CPU 50 decides the rotation period of time of the motor 53, and rotates the motor 53 for such period of time.

Further, in the event that a patch latent image for detection of the image density is formed on the surface of the photosensitive drum 1, a developing bias is applied to the developing sleeve 41 by the electrical power source for applying a developing bias, and the developing sleeve 41 is rotated in a direction indicated by the arrow to develop the patch latent image. The density of a test patch (a patch image) serving as a developed test pattern is then detected by the image density detecting sensor 13, and is read as an image density signal. This value is compared with a reference value, and the toner supplying apparatus 49 is driven to supply toner such that the output of the image density detecting sensor 13 can be always maintained at a constant value. The image density is thus controlled, and an appropriate image can be obtained. As the image density detecting sensor 13, a conventional optical sensor of a light reflecting type can be used.

However, if the developer density is forcedly recovered at the time when recovery is performed after an anomalous condition of the developer density is detected, or when a decrease in the developer density due to emptiness of developer is recovered, fogging is likely to occur. Even if no fogging occurs, variation in the image density is liable to appear.

The first embodiment copes with the above problem in the following manner.

Conventionally, with respect to indication or display of error for the developer density, when an error indication about descent in the density is lighted on an operation panel (not shown), for example, there are two cases as follows;

(i) An ordinary job operation is executed without doing anything, and spontaneous recovery is awaited.

(ii) Toner is supplied, and the density is forcedly recovered.

In the former case, recovery of the error indication is given priority, so that an output of the image density is very thin immediately after the recovery, and the density is gradually recovered. The density, however, increases too high. On the other hand, in the latter case, much time is taken for recovery to stabilize the density. Accordingly, it is possible to cope with the problem of a thin-density condition. The density, however, becomes too high.

The first embodiment, therefore, aims at smoothly achieving recovery from the error condition in the light of the above disadvantages.

Figure 3:
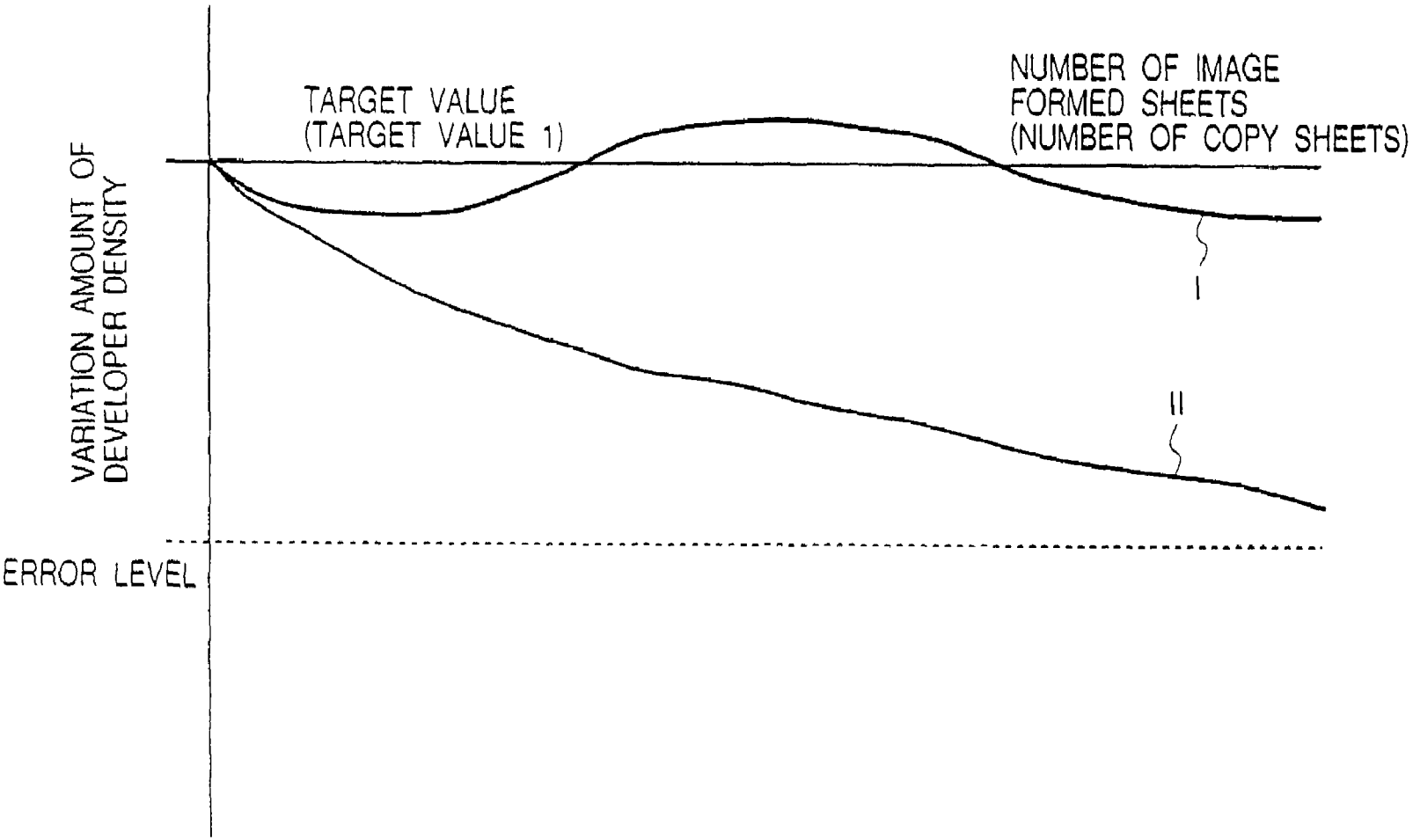
FIG. 3 is a view showing variation in a developer density of two-component developer contained in a developer container.

Generally, the density of developer in the developer container 44 is controlled such that the output value of the developer density detecting sensor 42 can be always kept near a target value as illustrated in FIG. 3. In other words, the rotation period of time of the motor 53 in the toner supplying apparatus 49 is controlled such that the developer density can be always kept at the target value. An actual density during this controlling operation is indicated by I in FIG. 3.

The output value of the density detecting sensor 42 in the developer container 44 of the developing device 4*y* is monitored to attain the above purpose. Upon detection of the fact that the output value deviates from the target value and the developer density decreases, a predetermined amount of toner is supplied to the developer container 44 from the toner supplying apparatus 49 by rotating the motor 53 for a predetermined period of time by the CPU 50. Accordingly, a content of toner in developer contained in the developer container 44 increases, and the output value of the developer density detecting sensor 42 is returned to its original value. When such operation is repeatedly performed, the density of developer in the developer container 44 can be stably controlled without being largely varied from the target value.

However, when the developer density varies as indicated by II in FIG. 3, there is a possibility of a case where a toner supply is fallen under an anomalous condition, for example, a case where no toner is present in the toner supplying apparatus 49.

Normally, the error level indicated in FIG. 3 is determined considering possible variations, and is accordingly a level that can be hardly lighted during an ordinary operation. That is to say, since the error level is determined well considering differences and variations among individual image forming apparatuses, it is relatively largely remote from a normal target value of developer.

Figure 4:
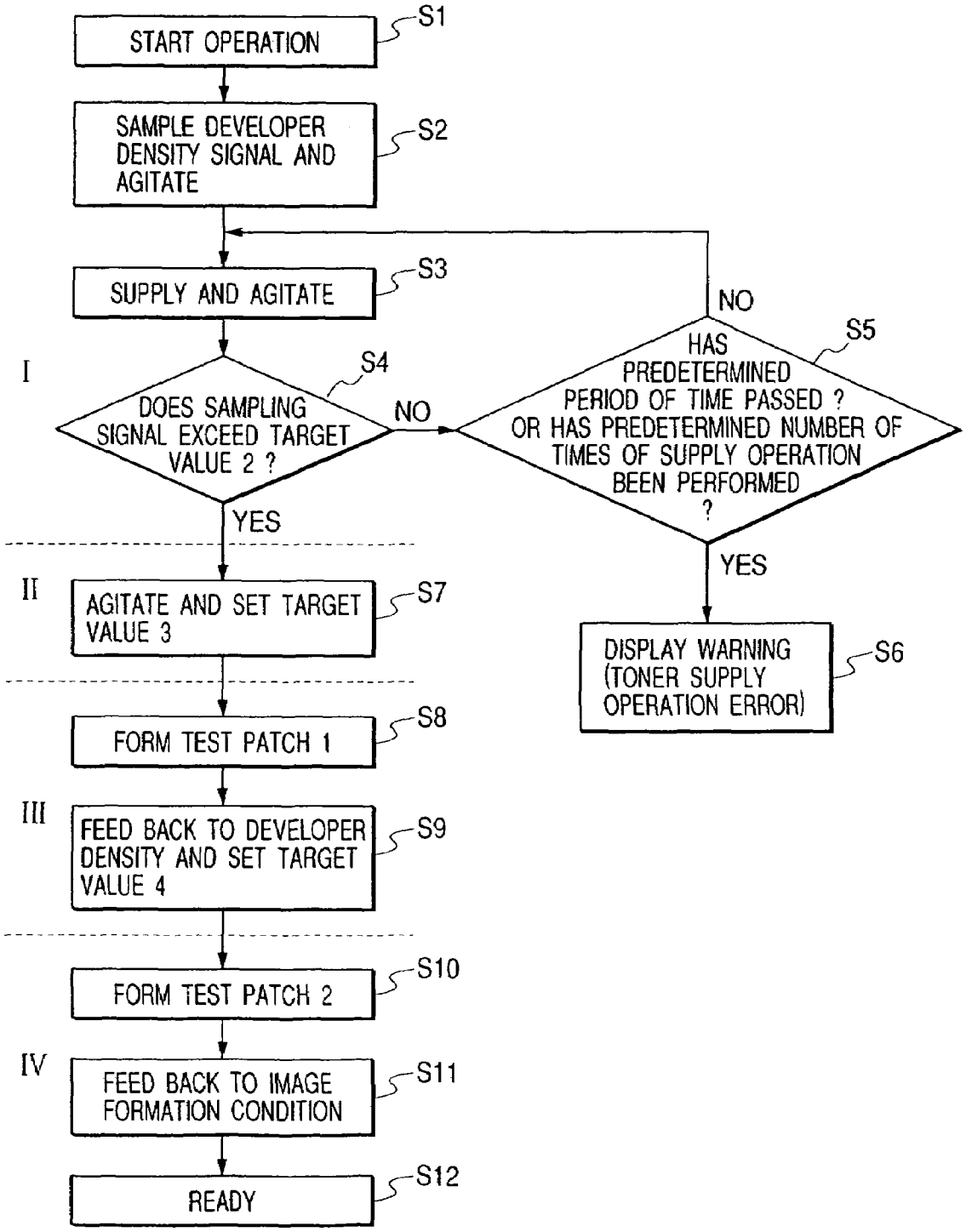
FIG. 4 is a flowchart showing a flow of recovery operation subsequent to detection of an anomalous condition of the developer density.

When the above density error occurs, the CPU 50 controls a recovery operation (supply of toner and control of the image density) for recovering the density error from a condition under which image formation is forcedly prohibited in conformity with the flow chart shown in FIG. 4. In the following discussion, with respect to a target value 1 (a target value (a final target value) at the time prior to occurrence of the density error), a target value 2 (a target value at a first stage), a target value 3 (a target value at a second stage), and a target value 4 (a target value at a third stage), the relationship of T1>T3>T2>T4 is established where T1, T2, T3 and T4 are variation amounts of those target values 1, 2, 3 and 4 from the error level, respectively. Here, the target values T2, T3 and T4 other than the final target value 1 are assumptive target values, respectively.

Initially, toner is supplied up to the target value 2 (described later in detail) at the first stage (I).

As discussed above, since the target value (the target value 1) for supply of toner is much remote from the error level, toner is likely to be excessively supplied if the developer density is recovered in a short time. Accordingly, the charge amount of toner in the developer container 44 abruptly decreases. Hence, unfavorable agitation occurs, and fogging is liable to appear in the image. Even if no fogging appears, the image density is likely to be thicker than the target density.

The target value 2 is, therefore, set for supply of toner. It is desirable that the variation amount between the target value 2 and the error level is set to a value of 50 to 80 (T2) where the variation amount between the target value 1 and the error level is assumed to be 100 (T1). The absolute value of the amount of toner supply can be reduced by repeating toner supplies up to the target value 2.

More specifically, the target value 2 is set and operation is started (S1) as shown in the flowchart in FIG. 4. Then, sampling of a developer density signal is performed by the developer density detecting sensor 42, and agitation is performed by the agitating and carrying screws 43*a* and 43*b* (S2). Further, supply and agitation of toner are executed (S3). Judgment whether the sampling signal exceeds the target value 2 or not is made (S4). Here, in the event that the sampling signal does not exceed the target value 2, judgment if a predetermined period of time has passed, or if a predetermined number of supply operations have been performed is made (S5). If the result is "NO", the step 3 is regained, and supply and agitation of toner are again executed. The steps S3, S4 and S4 are repeated until the sampling signal exceeds the target value 2. In the event of "YES" in the above step 5, warning is displayed on an operation panel or the like such that a user can be informed of an anomalous condition of the toner supply operation (S6).

When toner is supplied at the first stage (I), the toner is sufficiently mixed in the entire developer, and is given a satisfactory charge amount. Hence, the entire developer can have a uniform density and a uniform charge amount. Then, the output value of the developer density detecting sensor 42 is sampled, and a thus-detected present value is set as the target value 3. The target value 3 is closer to the target value 1 than the target value 2.

At the third stage (III), the target value 4 of the developer density is set.

Figure 5:
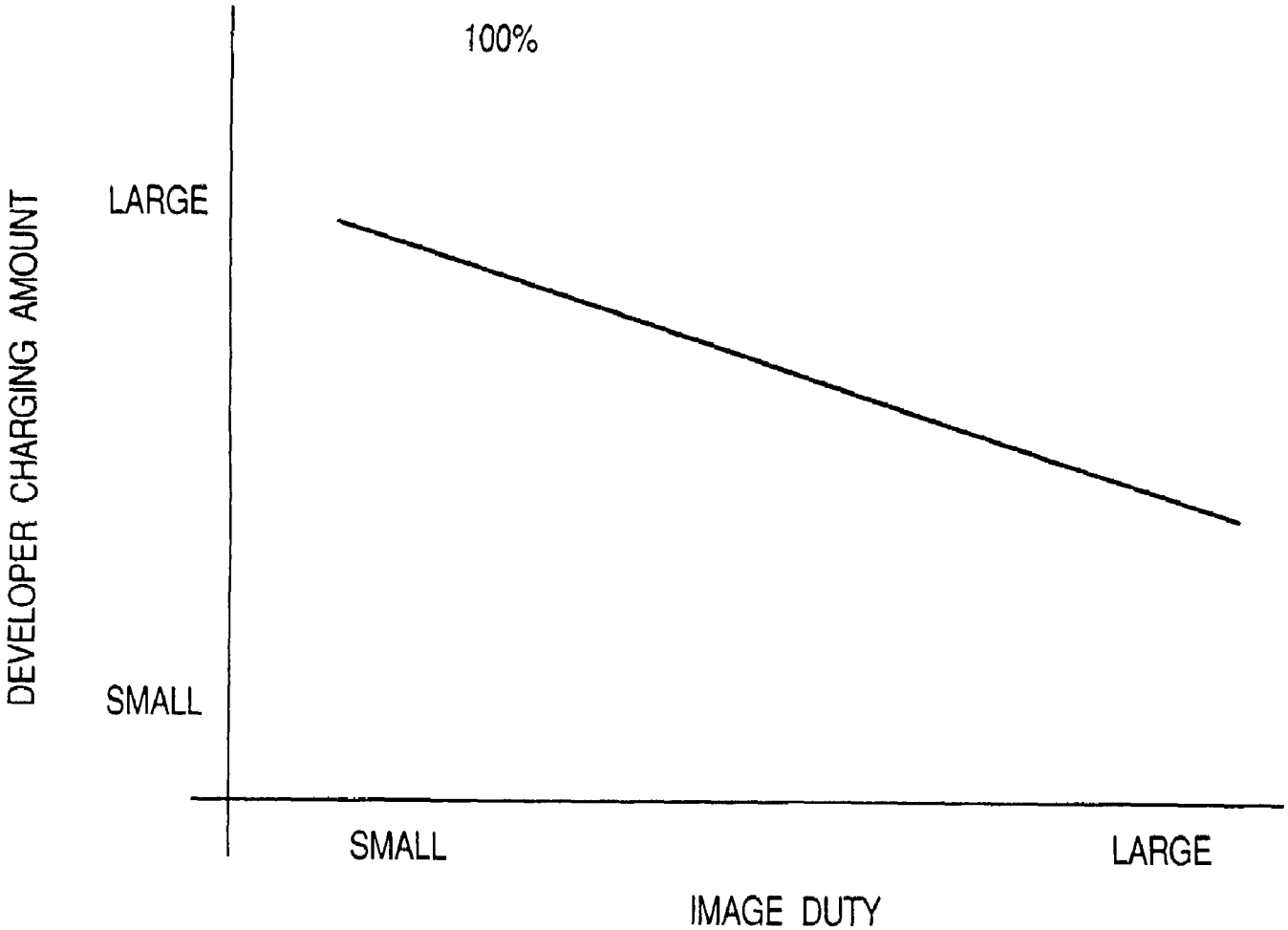
FIG. 5 is a view showing the relationship between an image duty and a developer charging amount (a developer charge amount)

Even when toner is supplied and sufficiently agitated, the charge amount of developer is small as compared with a normal use condition. Its value varies depending on an image duty (a coverage rate of an image) of an image on the original (document), as illustrated in FIG. 5. Where original images of a low image duty are continuously formed, the charge amount of developer increases and charge-up tendency is likely to occur. Conversely, where original images of a high image duty are continuously formed, the charge amount of developer is liable to decrease.

Therefore, a test patch 1 is formed (image formation) on the photosensitive drum 1 (S8), and its density is read by the image density detecting sensor 13. Variation of its output value from the output target value of the image density detecting sensor is then fed back to the developer density. Thereby, the target value 4 is set further considering the image density in exchange for the target value 3 of the developer density (S9). Accordingly, the image density is stabilized by introducing the developer density for rectifying the image density.

At the fourth stage (IV), feedback to an image formation condition is performed using a test patch.

For the purposes of further stabilizing the image density, a test patch 2 is formed on the photosensitive drum 1 (S10), and a signal read by the image density detecting sensor 13 is fed back to a gradation table to preferably maintain the gradation particularly. The gradation can be thus stabilized. Further, at this moment, the image density can be further stabilized by performing feedback to a developing contrast potential of the image formation condition (S11). Thus, recovery from the error indication is completed, and preparation for image formation is achieved (S12).

The fourth stage (IV) needs only to be performed when necessary. In order such that a period of time incapable of image formation can be made as short as possible, it is permissible to treat a condition after completion of the third stage (III) as a "ready" condition without performing the fourth stage (IV).

When recovery from the error display is executed as discussed above, occurrence of the foggy image due to excessive supply of toner can be prevented, and hence the image density can be stabilized. Further, since excessive supply of toner can be oppressed, it is possible to obtain a stable output image in a short time without aiding a rise in the density with forced consumption of toner.

A recovery sequence without the second and fourth stages (II and IV) can be adopted as discussed later. Specifically, in the event that the target value 2 is set, toner is supplied and the output of the developer density detecting sensor reaches the target value 2 at the first stage (I), the following operation is performed. The test patch formation process at the third stage (III) is carried out. The target value 2 is corrected to newly set a new target value 2' based on the image density of the test patch, while the image density of the test patch is being confirmed as appropriate. A "ready" condition (a condition capable of initiating image formation) is thus established. In such a construction, it is possible to make a period of time from the occurrence of error to the recovery of error, i.e., a period of time incapable of performing image formation, as short as possible while occurrence of fogging and an anomalous condition of the image density is prevented. Further, in such a construction, only in the event that the image density of the test patch at the third stage (III) is not appropriate, it is permissible that operation proceeds to the fourth stage (IV), a process for making the image density appropriate is selectively executed, and then the thus-established condition is set as a "ready" condition.

(Second Embodiment)

With respect to supply of toner, especially occurrence of fogging at the time when toner is a little excessively supplied, its influence is particularly large in a cleaner-less image forming apparatus. There is a great fear that a foggy image is moved together with the photosensitive drum, and interrupts charging to further enhance the fogging.

A second embodiment is therefore directed to a cleaner-less image forming apparatus.

The image forming apparatus has image formation processes such as charging, exposure, development, transfer, fixation and cleaning. In an image forming apparatus with a cleaner, toner (non-transferred residual toner) remaining on the surface of a photosensitive drum 1 after transferring operation is collected by a cleaning unit (cleaner) to be waste toner. It is preferable from the standpoints of environmental protection and so forth that no waste toner is generated.

Figure 6:
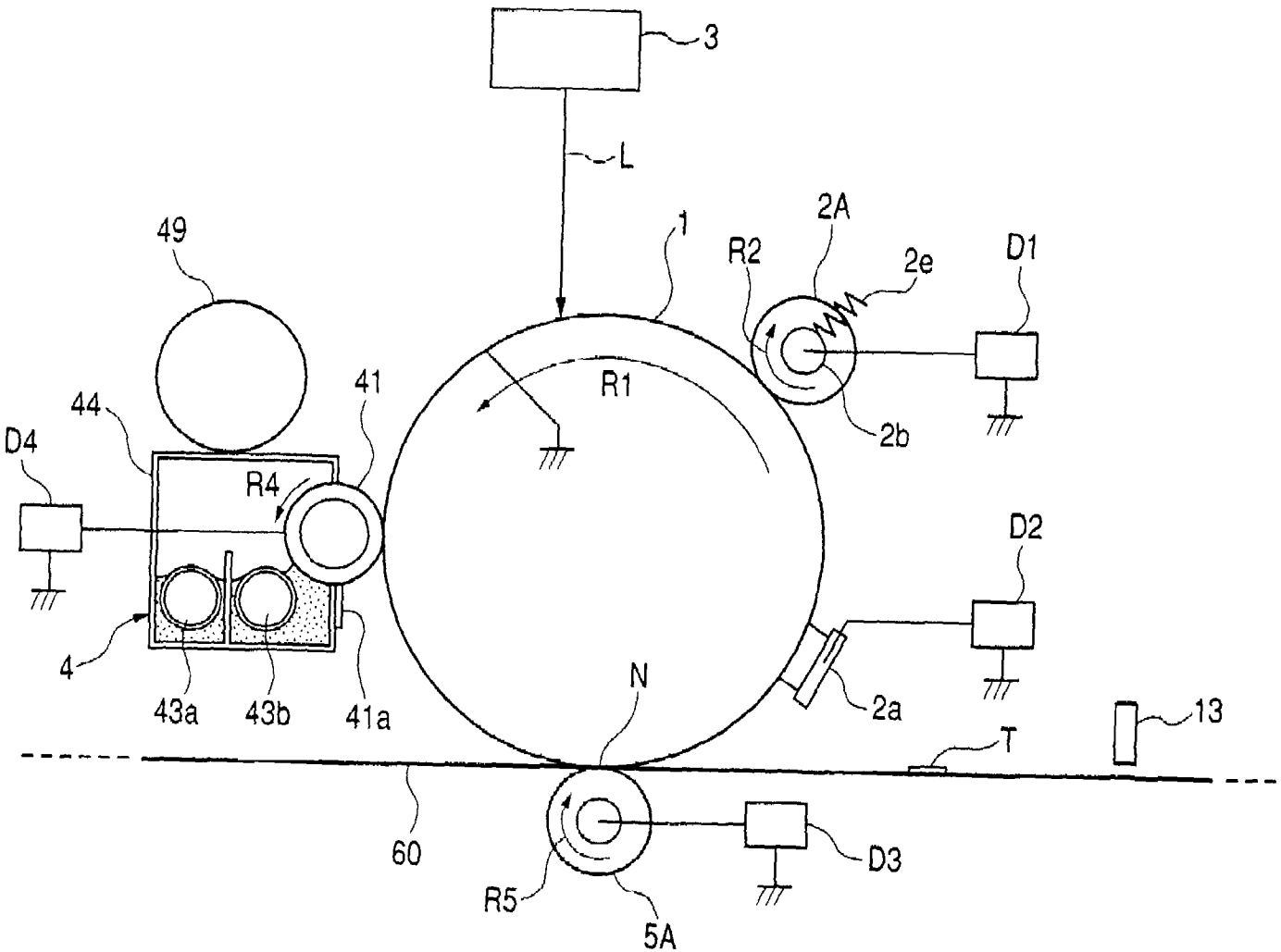
FIG. 6 is a longitudinal cross-sectional view schematically illustrating the structure of a second embodiment according to the present invention.

FIG. 6 schematically illustrates a cleaner-less type image forming apparatus of the second embodiment.

The photosensitive drum 1 serving as an image bearing member is driven and rotated in a direction indicated by the arrow R1 at a predetermined process speed (a circumferential speed) by a driving unit (not shown).

The surface of the photosensitive drum 1 is charged by a charging roller 2A serving as a charging unit. The charging roller 2A is urged toward the photosensitive drum 1 by an urging member 2*e*, which is in engagement with longitudinal opposite end portions of a core metal 2*b*. Accordingly, the charging roller 2A is pressed against the surface of the photosensitive drum 1, and is rotated in a direction indicated by the arrow R2 following the rotation of the photosensitive drum 1 in the direction indicated by the arrow R1. A charging bias is applied to the core metal 2*b* of the charging roller 2A by an electrical power source D1 for applying a charging bias. Thereby, the surface of the photosensitive drum 1 is uniformly charged at a predetermined potential of a predetermined polarity.

Exposure of the charged photosensitive drum 1 is performed by an exposing apparatus (an exposing unit) 3 based on image data, and charges on its exposed portions are removed such that an electrostatic latent image can be formed.

The electrostatic latent image is developed by a developing apparatus (a developing unit) 4. The developing apparatus 4 includes a developer container 44, agitating and carrying screws 43*a* and 43*b* for agitating and carrying two-component developer contained in the developer container 44, a developing sleeve 41 for developing an electrostatic latent image on the surface of the photosensitive drum 1 with developer carried on its surface, and a regulating blade 41*a* for regulating the developer carried on the surface of the developing sleeve 41 to be a thin layer. The developing sleeve 41 rotates in a direction indicated by the arrow R4 while carrying developer on its surface and being in contact with the surface of the photosensitive drum 1. Further, a developing bias is applied to the developing sleeve 41 by an electrical power source D4 for applying a developing bias. Accordingly, toner in developer is applied to the electrostatic latent image on the photosensitive drum 1, and the electrostatic latent image is developed as a toner image.

A toner supplying apparatus 49 is provided above the developing apparatus 4. The toner supplying apparatus 49 supplies toner to the developing apparatus 4 when the toner density in the developing apparatus 4 lowers. The toner supplying apparatus 49 has the same construction as the toner supplying apparatus 49 in the first embodiment illustrated in FIG. 2.

The thus-formed toner image on the photosensitive drum 1 is transferred to a recording material 60, such as a sheet of paper, by a transferring roller 5A serving as a transferring member. The transferring roller 5A is in an approximate contact with the surface of the photosensitive drum 1 such that a transferring nip portion N can be formed between the transferring roller 5A and the photosensitive drum 1. The transferring roller 5A is rotated in a direction indicated by the arrow R5. Upon conveyance of the recording material 60 to the transferring nip portion N in a direction indicated by the arrow, a transferring bias is applied to the transferring roller 5A by an electrical power source D3 for applying a developing bias. Accordingly, the toner image on the photosensitive drum 1 is transferred to the recording material 60.

An image density detecting sensor 13 is provided downstream of the transferring nip portion N in a conveyance direction of the recording material 60. With respect to a toner image T transferred onto the recording material 60 at the transferring nip portion N as discussed above, its image density is detected by the image density detecting sensor 13.

On the other hand, with respect to toner (non-transferred residual toner) remaining on the surface of the photosensitive drum 1 without being transferred to the recording material 60, its charge is adjusted by a charging auxiliary member 2*a* to which a bias is applied by a voltage applying electrical source D2, and afterward it is brought to the charging roller 2A by rotation of the photosensitive drum 1 in the direction indicated by the arrow R1.

The cleaner-less system will hereinafter be described in detail.

In the cleaner-less system, no cleaning unit is provided, and non-transferred residual toner on the photosensitive drum 1 is removed from the photosensitive drum 1 by the developing apparatus 4 in a "cleaning simultaneous with developing" manner. The thus-removed toner is collected into the developing apparatus 4 for reuse.

The "cleaning simultaneous with developing" method is a method in which a small amount of non-transferred residual toner remaining on the photosensitive drum 1 is collected at the time of the developing operation subsequent to the transferring operation by a fogging removing bias (a potential difference Vback which is a potential difference between a DC voltage applied to the developing apparatus and a surface potential of the photosensitive drum). According to this method, since the non-transferred residual toner is collected by the developing apparatus 4, and reused in the following processes, it is possible to eliminate waste toner, and reduce maintenance works. Further, due to the cleaner-less construction, the image forming apparatus is advantageous in terms of spatial capacity, and can be drastically reduced in size. Further, where a charging apparatus for the photosensitive drum is a contact-type charging apparatus, non-transferred residual toner is once collected by the contact charging member (the transferring roller 2A) in contact with the photosensitive drum 1, and is discharged onto the photosensitive drum 1 again and collected by the developing apparatus 4. Further, the image density detecting sensor 13 detects the toner image T formed (transferred) on the recording material 60 to detect the image density.

In the image forming apparatus of a contact charging system in which the transferring roller 2A is brought into contact with the surface of the photosensitive drum 1, thereby applying a charging bias to and charging the photosensitive drum 1 as illustrated in FIG. 6, non-transferred residual toner is collected into the charging auxiliary member 2*a*. This toner is applied to the photosensitive drum 1 in a cleaning sequence which is normally called a sweep-out mode, and is collected by the developing apparatus 4 to prevent contamination of the photosensitive drum 1. Toner is thus recycled. Timing for operating the sweep-out sequence is controlled using the accumulated number of copy sheets and an accumulated value of the toner consumption amount.

However, the amount of toner stored in the charging auxiliary member 2*a* varies depending on operation condition and use environment of the image forming apparatus, and it is difficult to achieve optimum timing and optimum control time. Therefore, there is a fear that the accumulated amount of non-transferred residual toner exceeds its saturation condition. Particularly, those timing and control are severe at the time when high-duty images are continuously output, in which case toner is excessively supplied. A more severe condition occurs during the recovery operation for performing recovery from a lighting time of an anomalous condition of the developer density.

In such cases, toner swept out during the image formation operation interrupts charging, and a desired charged potential cannot be obtained. Further, the toner intercepts exposure light, and prevents formation of the electrostatic latent image. Accordingly, defective images, such as toner fogging and partial image loss, are likely to occur.

Also in the second embodiment, therefore, similar to the first embodiment, recovery operation is performed after detection of the anomalous condition such that occurrence of the foggy image due to excessive supply of toner can be prevented, and the image density can be stabilized. Further, since excessive supply of toner can be oppressed, it is possible to obtain a stable output image in a short time without aiding a rise in the density with forced consumption of toner.

Further, the image density detecting sensor 13 can be disposed facing the surface of the photosensitive drum 1 downstream of the developing apparatus 4 and upstream of the transferring roller 5A along the rotation direction of the photosensitive drum 1, such that the density of the patch image on the photosensitive drum 1 can be detected the image density detecting sensor 13. Also in this case, the same advantageous effect can be obtained. Further, in an image forming apparatus using an intermediate transferring belt or an intermediate transferring drum as the intermediate transferring member, it is possible to detect the image density of the patch image formed on the intermediate transferring member by the image density detecting sensor.

According to the above-discussed embodiments, as described in the foregoing, when the developer density detecting sensor detects the error level which exhibits variation over a predetermined level of the density of toner in the developing apparatus, an assumptive target value between the error level and the target value is set, and toner is supplied by the toner supplying apparatus based on this assumptive target value in the recovery operation sequence for performing recovery operation from a condition under which image formation is prohibited. In such a construction capable of achieving the above operation, occurrence of fogging and the anomalous condition of the image density due to excessive toner supply can be prevented. Further, the test patch is formed with developer subsequent to toner supply based on the assumptive target value, and feedback to the image formation condition is performed such that the image density of a predetermined value can be achieved based on the image density of the test patch detected by the image density detecting sensor. Accordingly, variation of the image density can be effectively oppressed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a developing device, which develops an electrostatic image formed on an image bearing member with developer including toner and carrier;

a density sensor, which detects a density of the toner of the developer in said developing device;

control means for controlling an amount of toner to be supplied to said developing device by comparing a value regarding the density of the toner obtained from said density sensor with a target value;

prohibiting means for prohibiting an image forming operation when the value regarding the density of the toner obtained from said density sensor becomes equal to or less than an error level, the error level being a value smaller than the target value;

changing means for changing the target value from a first target value to a second target value when the value regarding the density of the toner obtained from said density sensor becomes equal to or less than the error level, the first target value being the target value before the value regarding the density of the toner becomes equal to or less than the error level, and the second target value being smaller than the first target value and larger than the error level; and recovering means for performing a recovery operation by supplying toner based on the second target value changed by said changing means after said prohibiting means prohibits the image forming operation.

2. An image forming apparatus according to claim 1, wherein when the value regarding the density of the toner obtained from said density sensor reaches the second target value with the recovery operation, said changing means changes the second target value to a third target value to continue the recovery operation, the third target value being smaller than the first target value and larger than the second target value.

3. An image forming apparatus according to claim 1, further comprising an image density sensor, which detects a density of a predetermined toner image formed on said image bearing member, wherein when the value regarding the density of the toner obtained from said density sensor reaches the second target value with the recovery operation, said changing means changes, on the basis of a value detected by said image density sensor, the second target value to a fourth target value to continue the recovery operation.

* * * * *

UNITED STATES PATENT AND TRADEMARK OFFICE

CERTIFICATE OF CORRECTION

PATENT NO. : 7,043,171 B2
APPLICATION NO. : 11/125083
DATED : May 9, 2006
INVENTOR(S) : Takao Ogata It is certified that error appears in the above-identified patent and that said Letters Patent is hereby corrected as shown below:

COLUMN 2

Line 42, "R," should read --A,--;
Line 44, "P." should read --B.--;
Line 45, "portion R," should read --portion A,--;
Line 54, "portion P." should read --portion B.--; and
Line 55, "portion P," should read --portion B,--.

COLUMN 3

Line 1, "portion R" should read --portion A--;
Line 7, "portion P," should read --portion B,--; and
Line 30, "supplied," should read --supplied--.

COLUMN 5

Line 53, "if" should read --whether--;
Line 54, "more" should read --greater--; and
Line 62, "beforehand obtained" should read --obtained beforehand--.

COLUMN 8

Line 40, "(S6)." should read --(S6). ¶In the event that the sampling signal exceeds the target value 2 at the above-described first stage (I) ("YES" in S4), operation proceeds to the second stage (II). At the second stage (II), the target value 3 is set (S7).--.

COLUMN 9

Line 17, "such" should be deleted.

UNITED STATES PATENT AND TRADEMARK OFFICE

CERTIFICATE OF CORRECTION

PATENT NO. : 7,043,171 B2
APPLICATION NO. : 11/125083
DATED : May 9, 2006
INVENTOR(S) : Takao Ogata It is certified that error appears in the above-identified patent and that said Letters Patent is hereby corrected as shown below:

COLUMN 12

Line 25, "detected" should read --detected by--.

Signed and Sealed this

Second Day of January, 2007

JON W. DUDAS
*Director of the United States Patent and Trademark Office*